US008985045B2

(12) United States Patent
Banfield et al.

(10) Patent No.: US 8,985,045 B2
(45) Date of Patent: Mar. 24, 2015

(54) CHOCK INSERT FOR A MARITIME CRAFT

(75) Inventors: Stephen Banfield, Leicestershire (GB); Kevin Black, Leicestershire (GB); Roger Hobbs, Leicestershire (GB); Mussa Mahomed, Leicestershire (GB)

(73) Assignee: Nylacast Ltd, Leicestershire (GB)

( * ) Notice: Subject to any disclaimer, the term of this patent is extended or adjusted under 35 U.S.C. 154(b) by 262 days.

(21) Appl. No.: 12/988,073

(22) PCT Filed: Apr. 15, 2009

(86) PCT No.: PCT/GB2009/000988
§ 371 (c)(1), (2), (4) Date: Feb. 16, 2011

(87) PCT Pub. No.: WO2009/127832
PCT Pub. Date: Oct. 22, 2009

(65) Prior Publication Data

US 2011/0132248 A1 Jun. 9, 2011

(30) Foreign Application Priority Data

Apr. 15, 2008 (GB) ..... 0806822.3

(51) Int. Cl.
*B63B 21/04* (2006.01)
*B63B 21/14* (2006.01)
*B63B 21/10* (2006.01)

(52) U.S. Cl.
CPC ..... *B63B 21/10* (2013.01)
USPC ..... 114/218; 114/179

(58) Field of Classification Search
CPC .... B63B 2021/003; B63B 21/10; B63B 21/14
USPC ..... 114/218, 219, 220, 381, 179, 18
See application file for complete search history.

(56) References Cited

U.S. PATENT DOCUMENTS

| | | | | | |
|---|---|---|---|---|---|
| 316,997 | A | * | 5/1885 | Murch | 114/218 |
| 748,618 | A | * | 1/1904 | Kidd | 114/218 |
| 4,173,194 | A | * | 11/1979 | McLaughlin | 114/218 |
| 5,216,972 | A | * | 6/1993 | Dufrene et al. | 362/477 |
| 5,280,138 | A | | 1/1994 | Preston et al. | |
| 5,307,751 | A | * | 5/1994 | Shell | 114/218 |

FOREIGN PATENT DOCUMENTS

| | | | | |
|---|---|---|---|---|
| CN | 1323270 | A | | 11/2001 |
| FR | 2371371 | | * | 6/1978 |
| JP | 53082195 | | * | 7/1978 |
| JP | 56-101052 | A | | 8/1981 |
| JP | 09-115370 | A | | 5/1997 |
| JP | 2000-062683 | A | | 2/2000 |
| JP | 3109434 | U | | 3/2005 |
| JP | 2006-008169 | A | | 1/2006 |

* cited by examiner

*Primary Examiner* — S. Joseph Morano
*Assistant Examiner* — Andrew Polay
(74) *Attorney, Agent, or Firm* — Rothwell, Figg, Ernst & Manbeck, P.C.

(57) ABSTRACT

A chock insert for a maritime craft comprises a body 10 arranged to be received within or mounted to a chock. The body 10 has a passageway therethrough to allow passage of a rope. The body 10 defines a rope running surface over which rope passing through the passageway can run, the rope running surface comprising a plastics material.

19 Claims, 6 Drawing Sheets

CHOCK INSERT FOR A MARITIME CRAFT

CROSS REFERENCE TO RELATED APPLICATIONS

Figure 1:
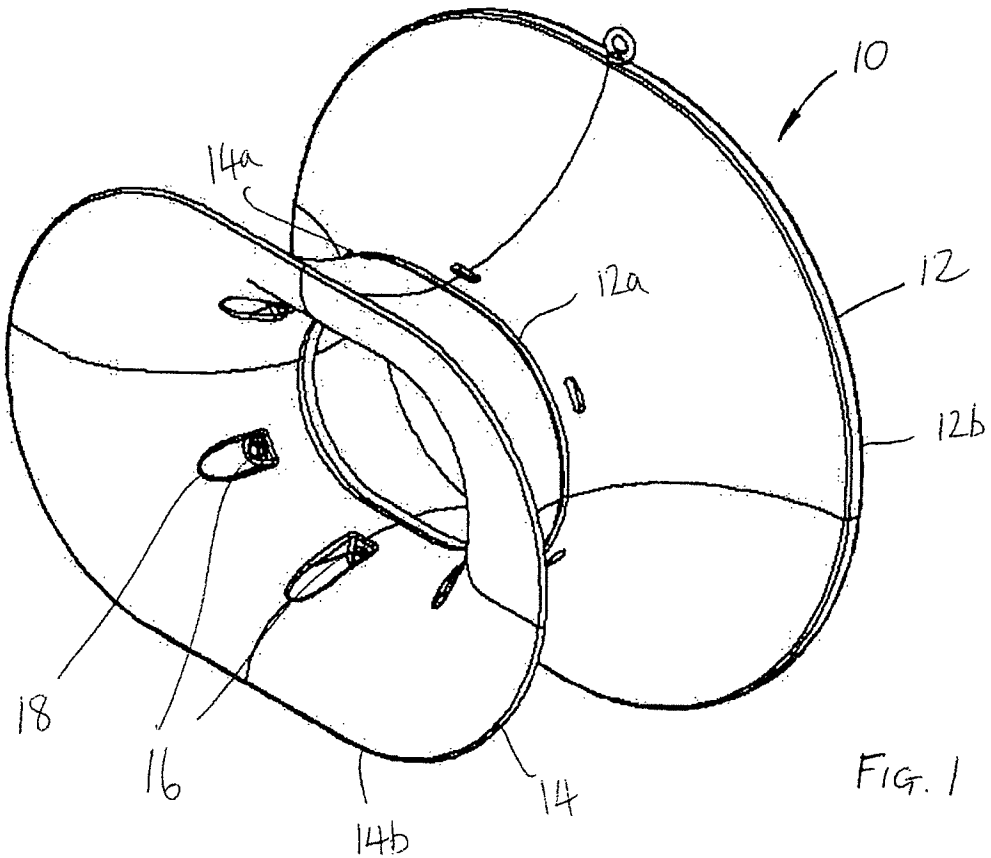

This application is a 35 U.S.C. §371 National Phase Entry Application from PCT/GB2009/000988, filed Apr. 15, 2009, and designating the United States, which claims the benefit of Great Britain Patent Application No. 0806822.3, filed Apr. 15, 2008, the disclosures of which are incorporated by reference.

The invention relates to a chock insert for a maritime craft, particularly a ship but also for use in rigs and floating platforms.

Chocks on ships, rigs, floating platforms and other maritime craft or installations generally comprise a flared aperture through which mooring ropes can pass. The flared nature of the chock is intended to prevent the mooring rope from passing over a small radius which would increase the level of wear on the rope. The mooring ropes are held under tension against the surface of the chock and the chock and rope running through it move relative to each other due to the movement of the craft, for example due to swell, the tides, wind and other phenomena.

Mooring ropes for large vessels such as tankers, gas carriers and container ships have typically been made from steel wire. However, these ropes are heavy which makes them difficult and time consuming to handle, placing an additional burden on crew and increasing time at berth. Also, as the wire ropes become worn individual wires break away and they can cut the hands of rope handling personnel. Also, in the salt water environment steel ropes can be subject to corrosion. Accordingly, synthetic fibre ropes have been offered as an alternative to steel. Generally these synthetic fibre ropes are made from a high modulus polyethylene fibre, aramid fibre or liquid crystal polyester fibre, all of which combine high strength with good resistance to stretch and make their performance largely equivalent to steel wire rope. The ropes are lighter and easier to handle. They tend not to present sharp fibres as they wear. Also, steel ropes are prone to sparking as they drag along the deck and that risk, which is significant when it occurs on a tanker or gas carrier, is eliminated with the synthetic fibre rope.

One issue with the synthetic fibre ropes in relation to steel ropes is that they have a relatively poor wear resistance. The chocks on vessels are generally made of sand cast steel. Whilst the sand cast steel surface does not present a wear problem for steel wire rope, the surface is rough enough to accelerate wear in fibre ropes. Chocks are also prone to rust which increases the abrasive qualities of the chock when the fibre rope is passing over it.

It is an object of the invention to provide an improved chock insert for a maritime craft.

According to one aspect of the invention there is provided a chock insert for a maritime craft comprising a body arranged to be received within or mounted to a chock, the body having a passageway therethrough to allow passage of a rope the body defining a rope running surface over which rope passing through the passageway can run, the rope running surface comprising a plastics material.

In that way, the fibre rope runs over a plastics material surface which is less abrasive.

The outer surface of the body of the chock insert is preferably arranged to conform to part of the inner surface of the chock. Most preferably, the outer surface of the body of the insert conforms substantially to the entire inner surface of the chock.

The body may be formed in two parts. The two parts of the body are preferably secured together compressively, for example by screw threaded fastener means, such as a series of nuts and bolts. Any gap that exists between the two parts of the body may be filled with a filler material. The two parts of the body may comprise an inner part and an outer part, the inner part being arranged to conform to the onboard side of the chock and the outer part being arranged to conform to the outboard side of the chock.

The passageway may be bounded on all sides by the body of the chock insert. The passageway may be circular, elliptical or obround.

The rope running surface preferably extends around the entrance to the passageway, the exit to the passageway or both sides of the passageway. The rope running surface may comprise the entire surface of the passageway. The plastics material of the rope running surface may comprise a removable plastics insert.

The plastics material may be one selected from the group of polyamide, polyester, epoxy or polyurethane. The plastics material may comprise a composite material comprising a plastics material matrix with a filler of different materials. The fillers may be provided so as to alter the performance of the rope running surface. The fillers may reduce the surface friction of the rope running surface. The fillers may improve the wear properties of the rope running surface. The fillers may be selected from the group of PTFE, FEP or graphite particles. Alternatively or in addition to the fillers, the plastics material matrix can have fibrous or other strengthening materials added to it. The fibrous materials may be glass, aramid or carbon fibre or other suitable fibre reinforcing material.

The body may be made by casting. Where the rope running surface comprises a separate plastics insert, the insert should be made by casting. Although it is less preferred, the body or insert could also be made by rotomoulding or injection moulding the plastics material.

Figure 2:
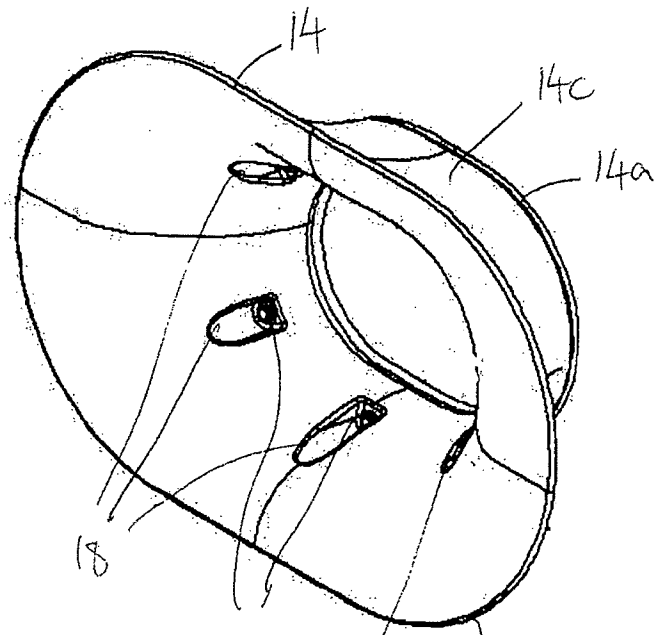
Figure 3:
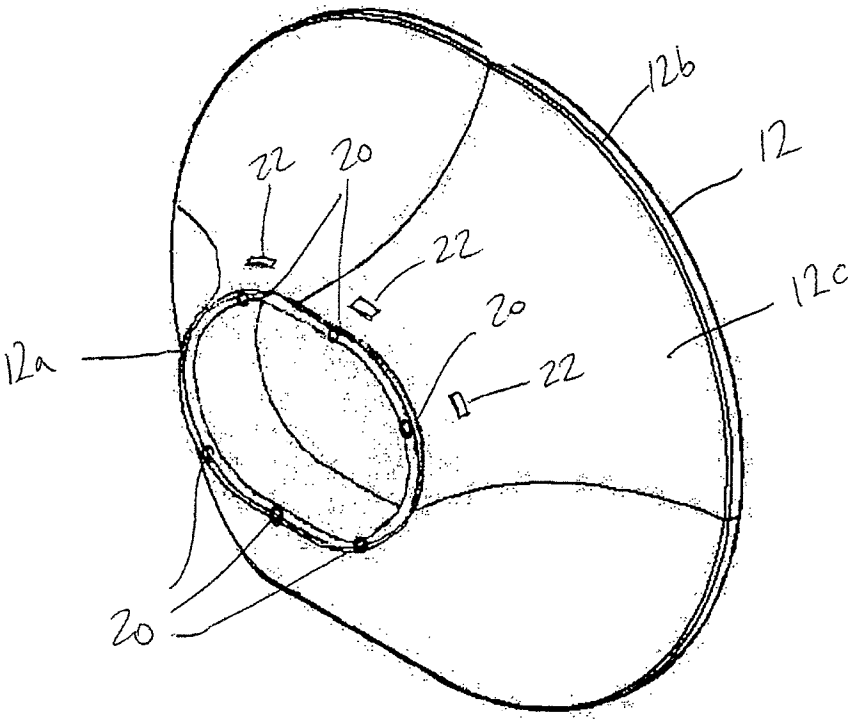
Figure 4:
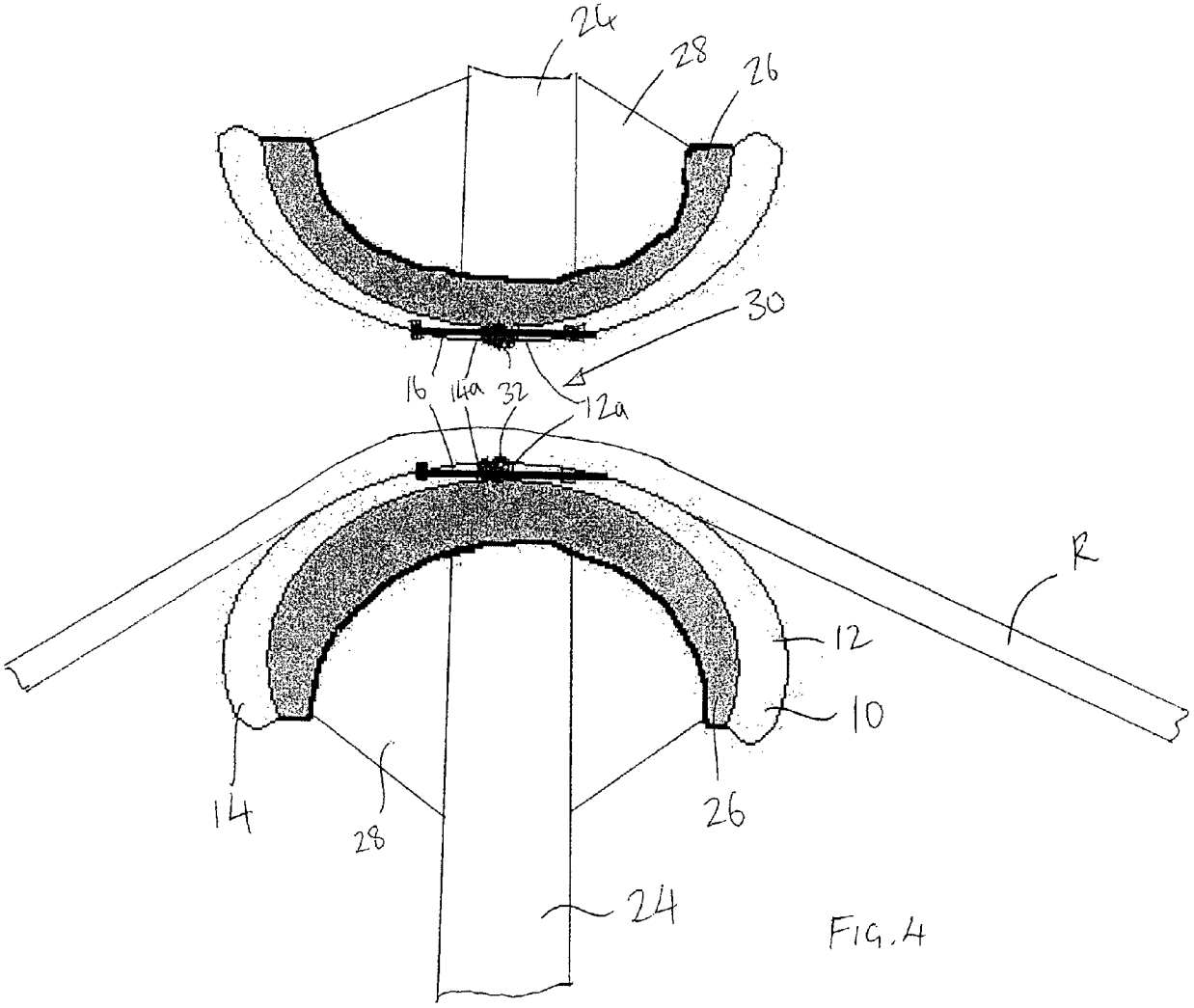
Figure 5:
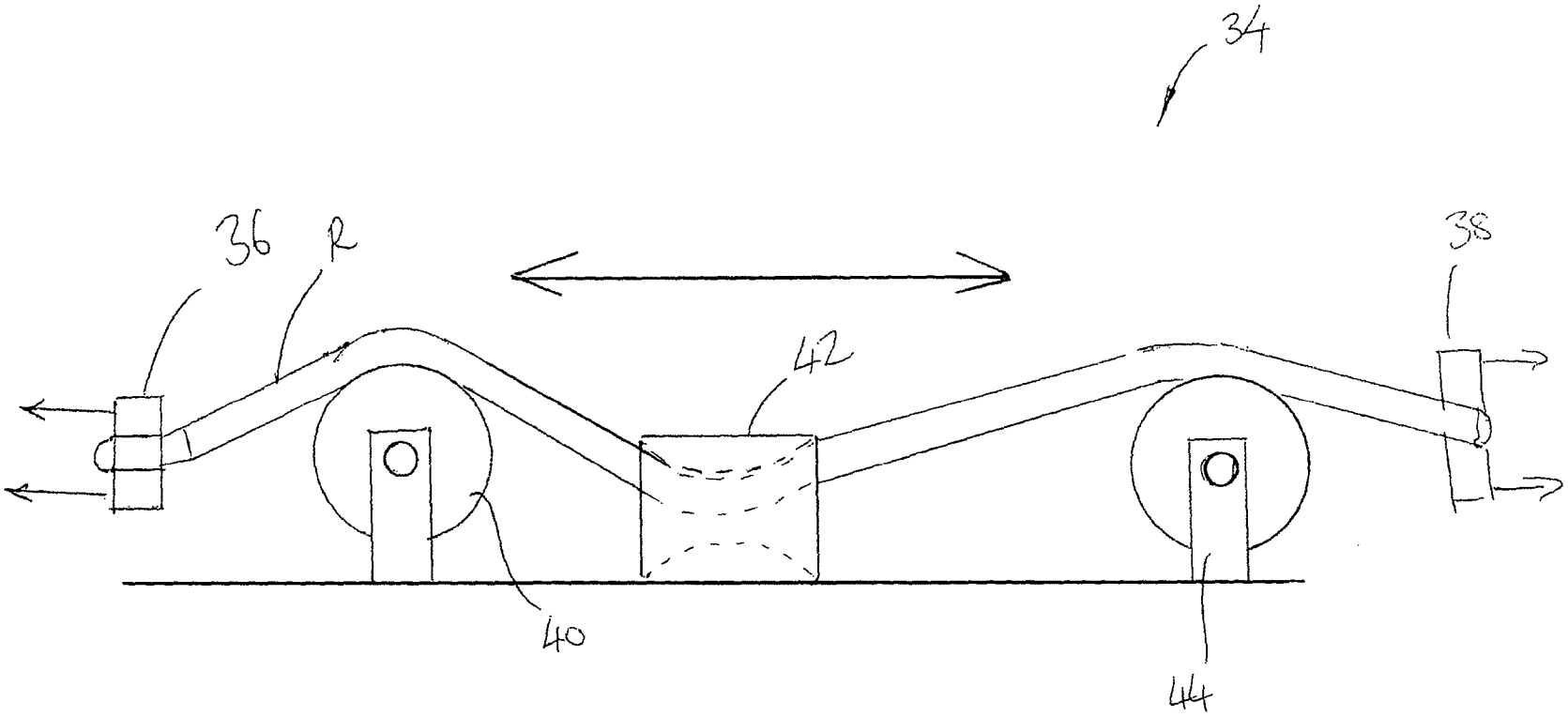
Figure 6:
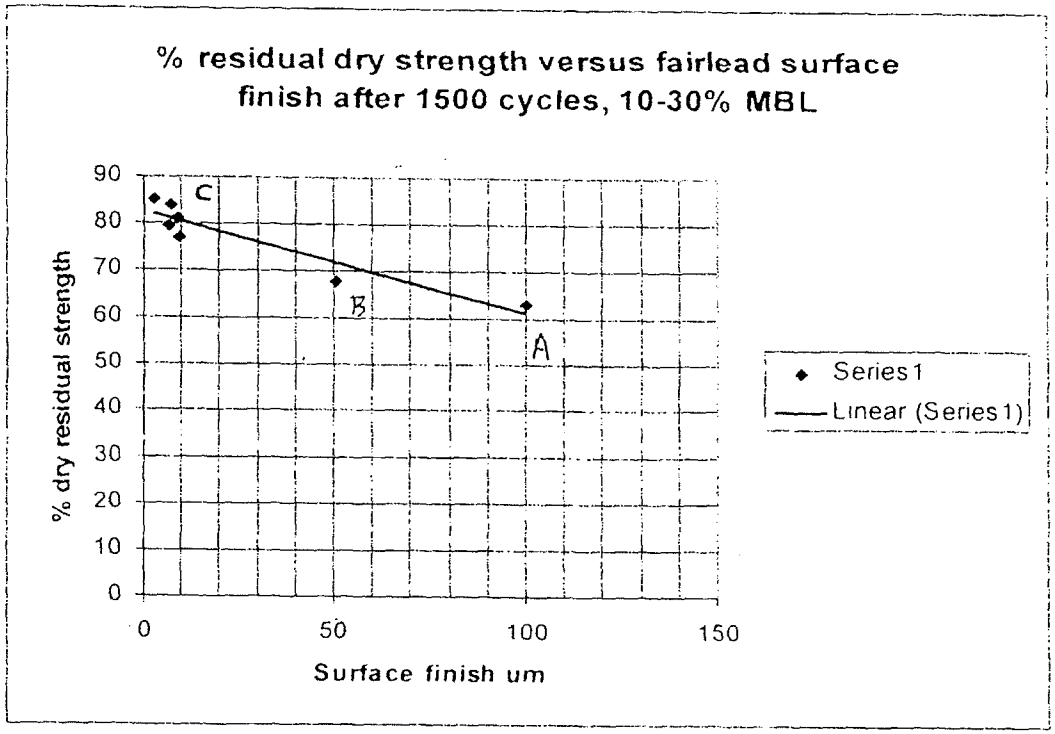

An embodiment of the invention will now be described in detail by way of example and with reference to the accompanying drawings, in which:

FIG. 1 is a perspective view of a chock insert in accordance with the invention, FIG. 2 is a perspective view of the first part of the chock insert, FIG. 3 is a perspective view of the second part of the chock insert, FIG. 4 is a schematic sectional view through a chock with the chock insert of FIGS. 1 to 3 installed thereon, FIG. 5 is a schematic illustration of a chock liner test rig, FIG. 6 is a table showing results of cycle testing of synthetic fibre rope.

In FIG. 1 a chock insert 10 comprises a first and second trumpet-shaped body parts 12, 14. The body parts 12, 14 butt together at their respective narrow ends 12*a*, 14*a* and flare outwardly to flared ends 12*b*, 14*b*. The parts 12, 14 are secured together by means of multiple nut and bolt fastener assemblies 16 which extend through apertures 18 and bores 20 formed respectively in each body part 14, 12.

The body parts 12, 14 are made of plastics material, for example a polyamide, a polyester, epoxy or a polyurethane.

The inner surfaces of the body parts 12, 14 define a rope running surface over which mooring rope can run. The plastics material surface is less abrasive to synthetic fibre rope than the surface of a chock.

In FIG. 2, one side of the chock insert 10 is shown.

The body part 14 in FIG. 2 is the craft side part of the chock insert. In other words, in use, that part is arranged to face towards the craft when installed on the chock. The body part 14 comprises an obround narrow end 14*a* and an obround wide end 14*b*. A parabolically flaring wall 14*c* extends between the narrow end 14*a* and the wide end 14*b*. Six fastener receiving apertures 18 are formed equally angularly spaced around the inside surface of the body part 14. The apertures 18 extend through the body part 14 and emerge on the end face of the body part 14 at the narrow end 14*a*. Only four apertures are shown in FIG. 2. Bolts 16*a* of the nut and bolt fastener assembly 16 are arranged in the apertures 18.

Turning to FIG. 3, the chock body part 12 shown is the quay-side part of the chock insert. In other words, the part 12 is the part that, when arranged on the ship or other maritime craft, faces towards the quay.

Again, as with the part 14, the part 12 comprises an obround narrow end 12*a*, an obround wide end 12*b* and a parabolically flared wall 12*c* extending between the ends 12*a*, 12*b*.

A series of bores 20 are formed in the end face of the narrow end 12*a* of the body part 12. The bores extend through the body towards the wide end 12*b* and they receive a nut of the nut and bolt fastener arrangement 16. Access apertures 22 extend from the outer surface of the body part 12 inwardly towards the bores 20 to enable either insertion or manipulation of a nut of the nut and bolt fastener arrangement 16.

In FIG. 4, the chock insert 10 is shown, schematically, assembled upon a chock of a ship or other maritime craft.

In FIG. 4, a ship (not shown) has a ship wall 24 in which a chock 26 is mounted. The chock 26 is supported by chock mounting webs 28 which may be bolted or welded to the ship wall 24.

The chock 26 defines an aperture generally indicated at 30 through the ship wall 24, through which a rope R can run. The running surface of the chock 26 is rough and tends to wear synthetic fibre rope. In FIG. 4, the chock insert 10 is arranged within the chock 26 so as to cover the surface of the chock 26. The chock insert 10 is secured on the chock by means of the nut and bolt arrangements 16 as shown in FIGS. 1-3. In the embodiment shown in FIG. 4, the narrow ends 12*a*, 14*a* of the chock insert body parts 12, 14 do not meet. The small gap between those ends 12*a*, 14*a* is filled using a known filler material 32. A typical filler material may be a silicon sealant material or a room temperature vulcanising polyurethane. As can be seen in FIG. 4, the rope R runs over the inner surface of the chock insert 10 rather than the surface of the chock 26. The inner surface of the chock 10 is considerably less wearing on synthetic fibre rope R than the surface of the chock.

In the chock insert of FIGS. 1-3, the quay-side part 12 is larger than the craft-side part 14. However, they may be identical in size or the craft-side part may be larger than the quay-side part. Also, various shapes of chock inserts are possible. For example, the parts 12, 14 could be conical in shape. Likewise the aperture defined by the chock insert 10 could vary in shape from circular, through elliptical to obround. It is likely that the aperture will always have a rounded profile and the inner surface of the insert will flare convexly so as to maximise the radii over which the rope must pass.

The chock insert 10 in accordance with the invention was tested in a test rig as shown in FIG. 5. In FIG. 5 a test rig 34 comprises opposite drive mechanisms 36, 38 which are spaced apart from each other and which drive away from each other. A rope R is secured between the drive mechanisms 36, 38 and passes over a first roller 40, through a chock 42 and over a second roller 44. The drive mechanisms 36, 38 are intended to pull the rope back and forth as illustrated by the arrow in FIG. 5 through the chock 42. Identical ropes were tested on an unfinished chock (A), on a smoothed chock (B) and then on a chock insert (C) in accordance with the invention. After 1500 cycles back and forth through the chock, the rope used on the unfinished chock retained just over 60% of its residual strength. The rope that was used in the relation to the smoothed chock had around 67% of its original strength. A series of ropes tested on the chock insert retained between 78% and 85% of their residual strength after 1500 cycles. Thus it can be seen that the use of the chock insert substantially improves the fatigue life of ropes passing through the chock insert in comparison to ropes passing through both finished and unfinished chocks.

An alternative chock comprises a framework of a first material, for example steel, with a plastics material insert received in the framework to define the rope running surface.

The invention claimed is:

1. A chock insert for a maritime craft comprising:

a first body part including a first end, a second end and a first series of bores, wherein the second end is flared and the first end is relatively narrower than the second end;

a second body part including a first end, a second end and a second series of bores, wherein the second end is flared and the first end is relatively narrower than the second end, wherein the first body part is coupled to the second body part to form a body and the parts are coupled together by fasteners engaged with each series of bores such that the first end of the first body part abuts the first end of the second body part;

the body arranged to be receivable within or mountable to a chock, the body having an outer surface and an inner surface, the inner surface defining an aperture through the body and bounded on all sides thereby to allow passage of a rope, the inner surface providing a substantially smooth rope running surface which rope passing through the aperture can run over in direct contact therewith, and the rope running surface comprising a plastics material and having a cross sectional area which varies along the length of the aperture from a relatively wide entrance via a narrowed aperture to a relatively wide exit, wherein the outer surface of the body forms a pocket to receive a wall of a boat, wherein the outer surface of the body of the insert conforms substantially to the entire inner surface of the chock.

2. A chock insert according to claim 1, in which the the first body part and the second body part are secured together compressively using fastener assemblies.

3. A chock insert according to claim 2, in which any gap that exists between the two parts of the body is filled with a filler material.

4. A chock insert according to claim 1, in which the first body part and the second body part comprise an inner part and an outer part, the inner part being arranged to conform to the onboard side of the chock and the outer part being arranged to conform to the outboard side of the chock.

5. A chock insert according to claim 1, in which the aperture is circular, elliptical or obround.

6. A chock insert according to claim 1, in which the rope running surface extends around an entrance to the aperture or an exit to the aperture or both entrance and exit of the aperture.

7. A chock insert according to claim 6, in which the rope running surface comprises the entire surface of the aperture.

8. A chock insert according to claim 1, in which the plastics material of the rope running surface comprises a removable plastics insert.

9. A chock insert according to claim 1, in which the plastics material is one selected from the group of polyamide, polyester, epoxy or polyurethane.

10. A chock insert according to claim 1, in which the plastics material comprises a composite plastics material matrix with a filler of different materials.

11. A chock insert according to claim 10, in which the filler is provided so as to alter one or more of the performance of the rope running surface, the surface friction of the rope running surface, or the wear properties of the rope running surface.

12. A chock insert according to claim 10, in which the filler is selected from the group of PTFE, FEP or graphite particles.

13. A chock insert according to claim 10, in which the plastics material matrix has fibrous or other strengthening material added to it.

14. A chock insert according to claim 13, in which the fibrous material is glass, aramid or carbon fibre or other suitable fibre reinforcing material.

15. A chock insert according to claim 1, in which the body is made by casting.

16. A chock insert according to claim 1, in which the rope running surface comprises a separate plastics insert and the insert is made by casting.

17. A chock insert according to claim 1, in which the chock insert is arranged on a chock and secured on the chock compressively, the chock insert comprising two parts and space between the parts is filled by a filling material.

18. A chock insert according to claim 1, wherein the first body part includes an inner coupling surface at a first end of the first series of bores and positioned adjacent the first end, and the second body part includes an inner coupling surface at a first end of the second series of bores and positioned adjacent the first end.

19. A chock insert according to claim 1, wherein the first body part includes first access apertures at a second end of the first series of bores, and the second body part includes second access apertures at a second end of the second series of bores.

* * * * *